US006957981B2

(12) United States Patent
Karino et al.

(10) Patent No.: US 6,957,981 B2
(45) Date of Patent: Oct. 25, 2005

(54) ELECTRICAL CONNECTOR

(75) Inventors: Kazuya Karino, Miyazaki (JP); Toshihiro Yoneda, Miyazaki (JP)

(73) Assignee: Honda Lock Mfg. Co., Ltd., Miyazaki (JP)

( * ) Notice: Subject to any disclaimer, the term of this patent is extended or adjusted under 35 U.S.C. 154(b) by 0 days.

(21) Appl. No.: 10/842,628

(22) Filed: May 11, 2004

(65) Prior Publication Data

US 2005/0014417 A1 Jan. 20, 2005

(30) Foreign Application Priority Data

May 15, 2003 (JP) ..... 2003-137774

(51) Int. Cl.[7] ..... H01R 13/58
(52) U.S. Cl. ..... 439/606
(58) Field of Search ..... 439/606, 604, 439/736, 686, 695

(56) References Cited

U.S. PATENT DOCUMENTS 4,094,564 A * 6/1978 Cacolici ..... 439/456
4,884,980 A * 12/1989 Bensing et al. ..... 439/606
5,993,256 A * 11/1999 Shimojyo ..... 439/604
6,227,916 B1 * 5/2001 Wu ..... 439/857
6,482,036 B1 * 11/2002 Broussard ..... 439/606
6,767,226 B2 * 7/2004 Varatta ..... 439/106

FOREIGN PATENT DOCUMENTS

JP A 2001-76798 3/2001

* cited by examiner

*Primary Examiner*—Gary Paumen
(74) *Attorney, Agent, or Firm*—Berenato, White & Stavish LLC

(57) ABSTRACT

An electrical connector formed by insert molding a portion of a cord having plural electric wires, and a portion of a metallic terminal having electric wire connection parts connected to the ends of the respective electric wires individually and electrically in a connector housing made of a synthetic resin, in which a holder comprises a holding portion for holding plural terminal containment grooves in contiguous with the holding portion while accommodating the electric wire connection parts and a portion of the electric wires, a welding window formed such that the electric wire connection part and the end of the electric wire can be welded by resistance welding, and plural supports abutting against and supported on a die for molding the connector housing and in which the holder, a portion of the terminals joined with the holder and a portion of the cord are covered with the connector housing with the top end of the support being exposed to the outer surface of the connector housing, whereby the connection structure between the electric wires of the cord and the terminals can be simplified and the connection operation can be facilitated.

2 Claims, 6 Drawing Sheets

ELECTRICAL CONNECTOR

BACKGROUND OF THE INVENTION

1. Field of the Invention

The present invention concerns an electrical connector in which a portion of a cord having plural electric wires and a portion of a metallic terminal having electric wire connection parts to be connected with the ends of respective electric wires individually and electrically are insert-molded in a connector housing made of a synthetic resin.

2. Statement of the Related Art

The electrical connector of the type described above has already been known, for example, in Japanese Patent Unexamined Application No. 13-76798 (JP-A No. 13-76898), in which a pair of electric wires of a cord are connected electrically to a pair of terminals by way of pressure terminals to be secured to the ends of the electric wires respectively.

In the electrical connector disclosed in the Patent Document described above, a portion of a holder is insert molded in a connector housing, and pressure terminals each of a width larger than that of each terminal are arranged in parallel to the holder while avoiding interference between the pressure terminals with each other. That is, in order to restrict the enlargement for the width of the holder, that is, the connector housing, a first terminal to be press fit into the pressure terminal and a dummy terminal are arranged in parallel on one surface of the holder, while a second terminal to be press fit into the other pressure terminal is arranged being electrically connected with the dummy terminal on the other surface of the holder. However, this constitution complicates the connection structure between each electric wire of the cord and each terminal, and also complicates the operation work of electrically connecting each electric wire and each terminal.

SUMMARY OF THE INVENTION

The present invention has been accomplished in view of the foregoing situations and intends to provide an electrical connector capable of simplifying the connection structure between electric wires of a cord and terminals, and facilitating connection operation.

The present invention provides an electrical connector formed by insert molding a portion of a cord having plural electric wires, and a portion of a metallic terminal having electric wire connection parts connected to the ends of the respective electric wires individually and electrically in a connector housing made of a synthetic resin, in which a holder comprises a holding portion for holding plural terminal containment grooves in contiguous with the holding portion while accommodating the electric wire connection parts and a portion of the electric wires, a welding window formed such that the electric wire connection part and the end of the electric wire can be welded by resistance welding, and plural supports abutting against and supported on a die for molding the connector housing and in which the holder, a portion of the terminals assembled with the holder and a portion of the cord with the electric wires thereof being connected electrically to the terminals are covered with the connector housing with the top end of the support being exposed to the outer surface of the connector housing.

In a preferred embodiment of the invention, each terminal is formed of a one piece member having a central bent part, a terminal connection part in contiguous at a right angle with one end of the central bent part and to be electrically connected with an external female terminal and an electric wire connection part in contiguous at a right angle with the other end of the central bent part, and the holding portion has a configuration complementary to the shape of the central bent portion and is formed to the holder so as to hold each terminal by fitting the central bent part of each terminal.

In accordance with the constitution described above, the electric wire and the electric wire connection part for each of the terminals contained in each of the containment grooves can be connected easily by resistance welding through the welding window in a state where the terminals are held to the plural holding portions of the holder respectively. In addition, each terminal and each electric wire in the state connected to each other can be held stably to the holder, and the connector housing can be insert molded easily by abutting and supporting the supports of the holder on a die upon molding of the connector housing, thereby facilitating insert molding of the connector housing while suppressing the rattling of the holder during molding.

DESCRIPTION OF THE ACCOMPANYING DRAWINGS

A preferred embodiment of the present invention will be described in details based on the drawings, wherein FIG. 1 is a side elevational view of an electrical connector according to the present invention;

DESCRIPTION OF A PREFERRED EMBODIMENTS OF THE INVENTION

A preferred embodiment of the present invention is to be described by way of an example of the invention with reference to the accompanying drawings.

Figure 1:
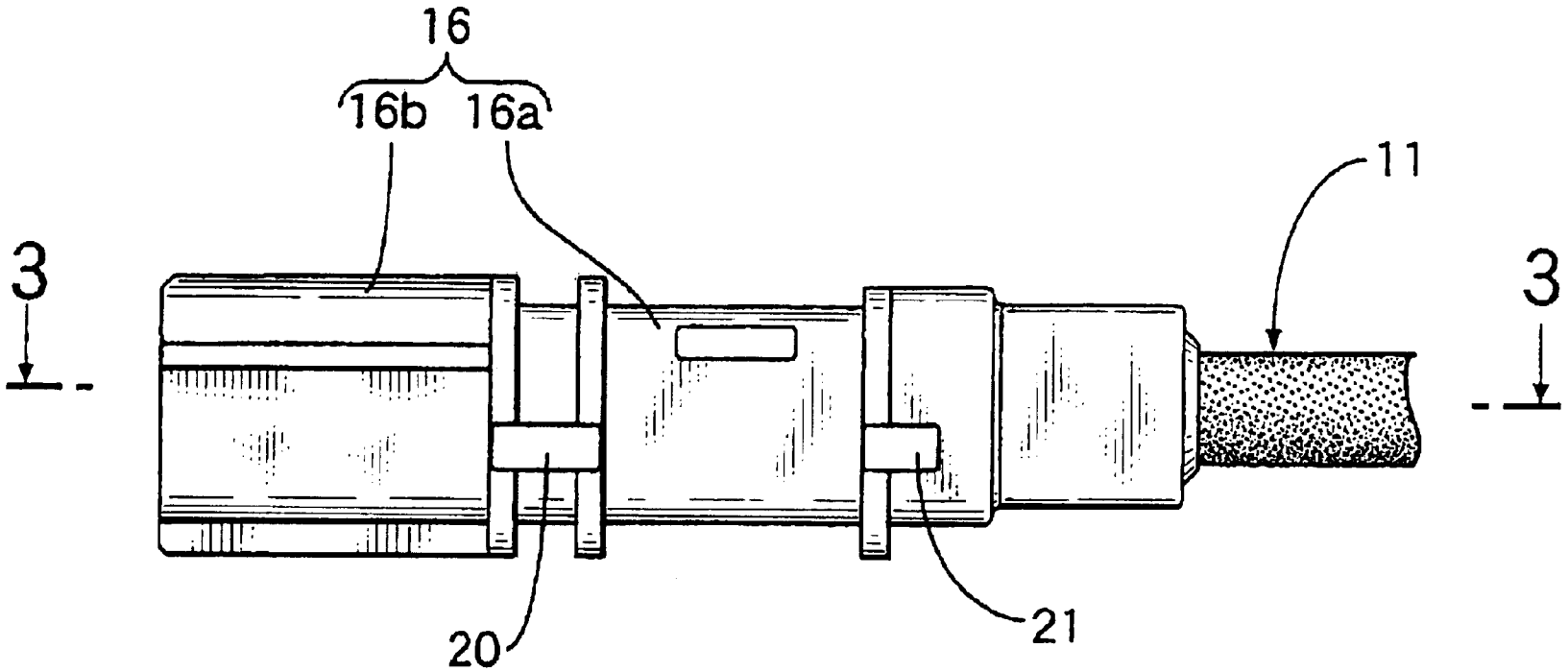
Figure 2:
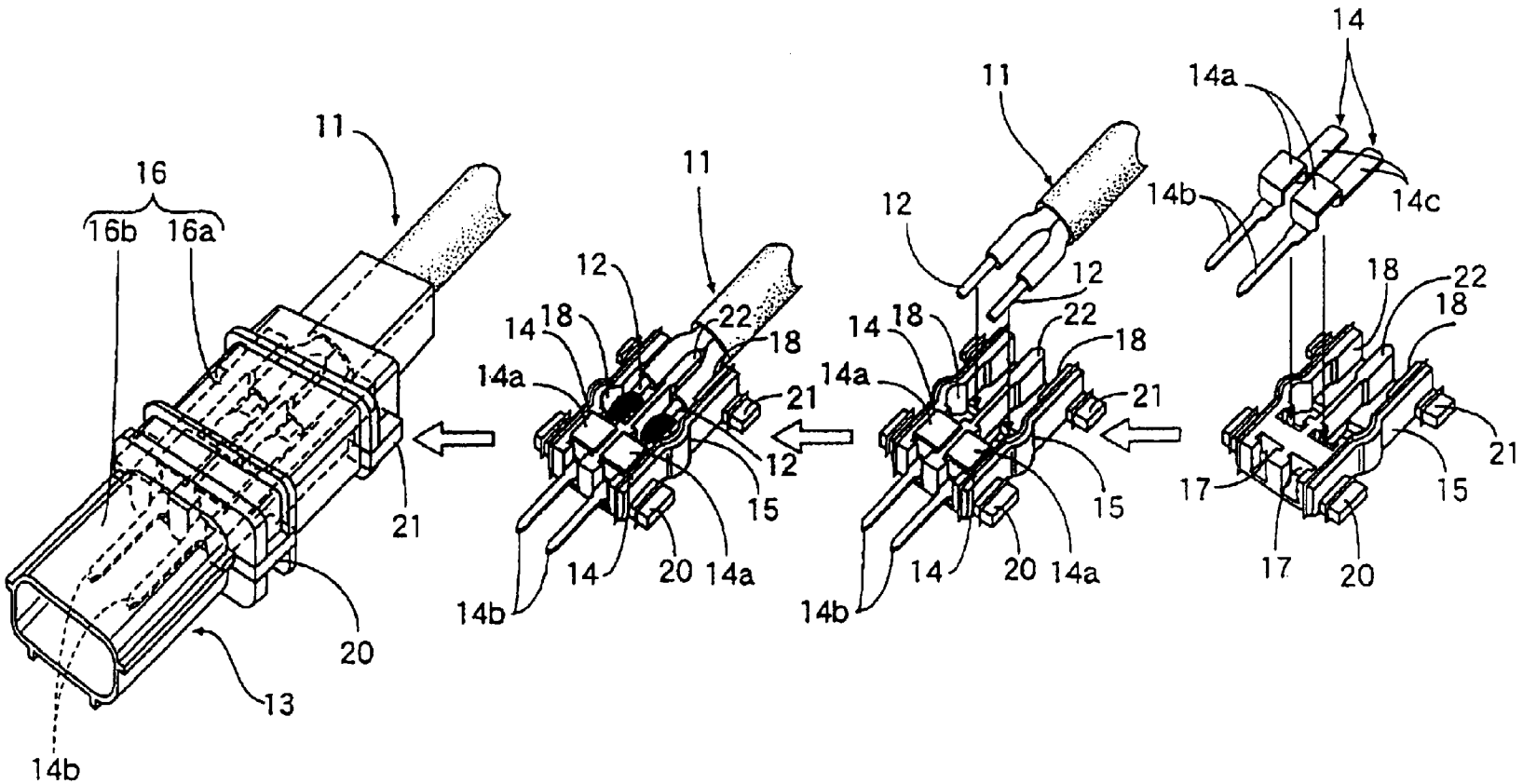
FIG. 2 is a perspective view showing the steps of manufacturing an electrical connector successively.
Figure 3:
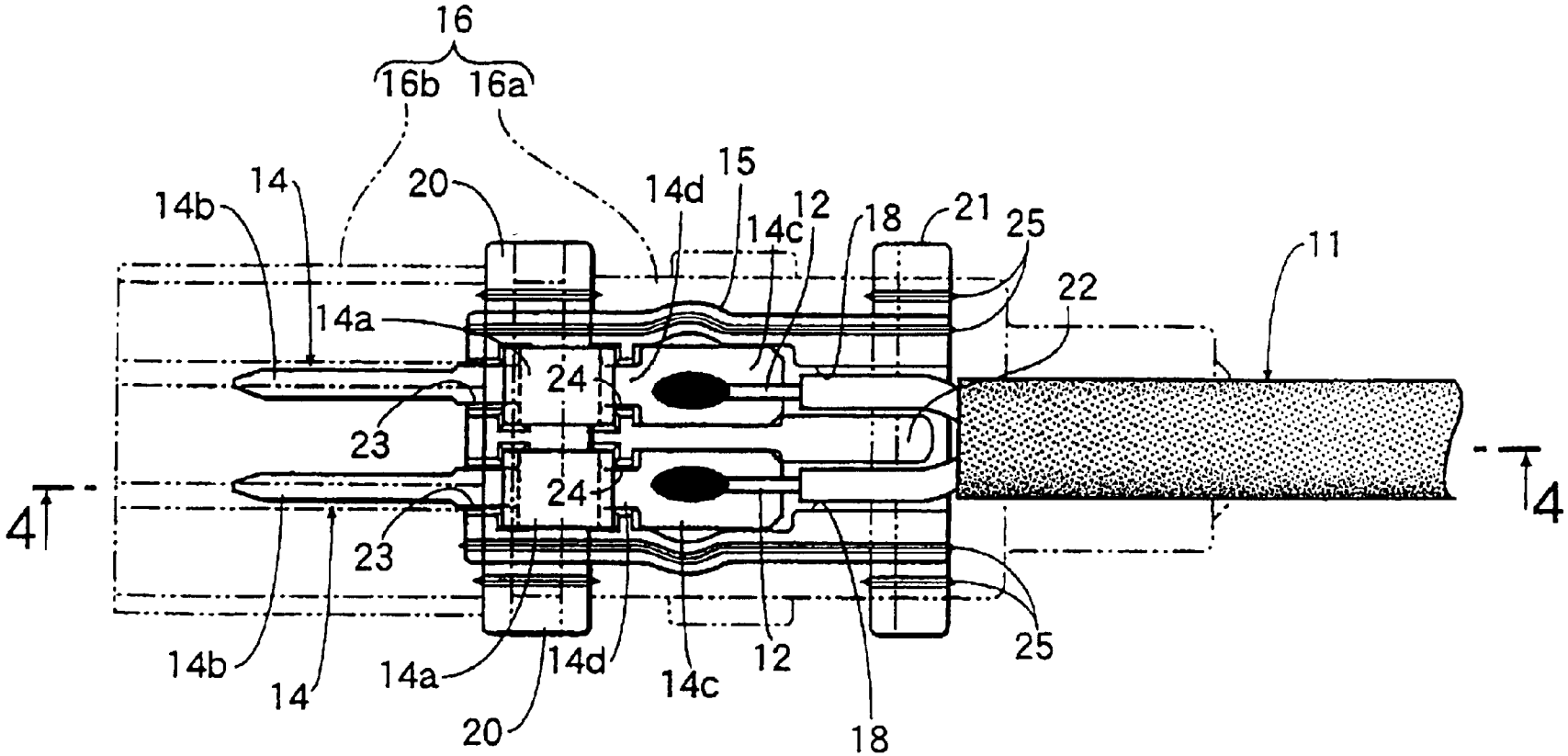
FIG. 3 is a cross sectional view taken along line 3—3 in FIG. 1.
Figure 4:
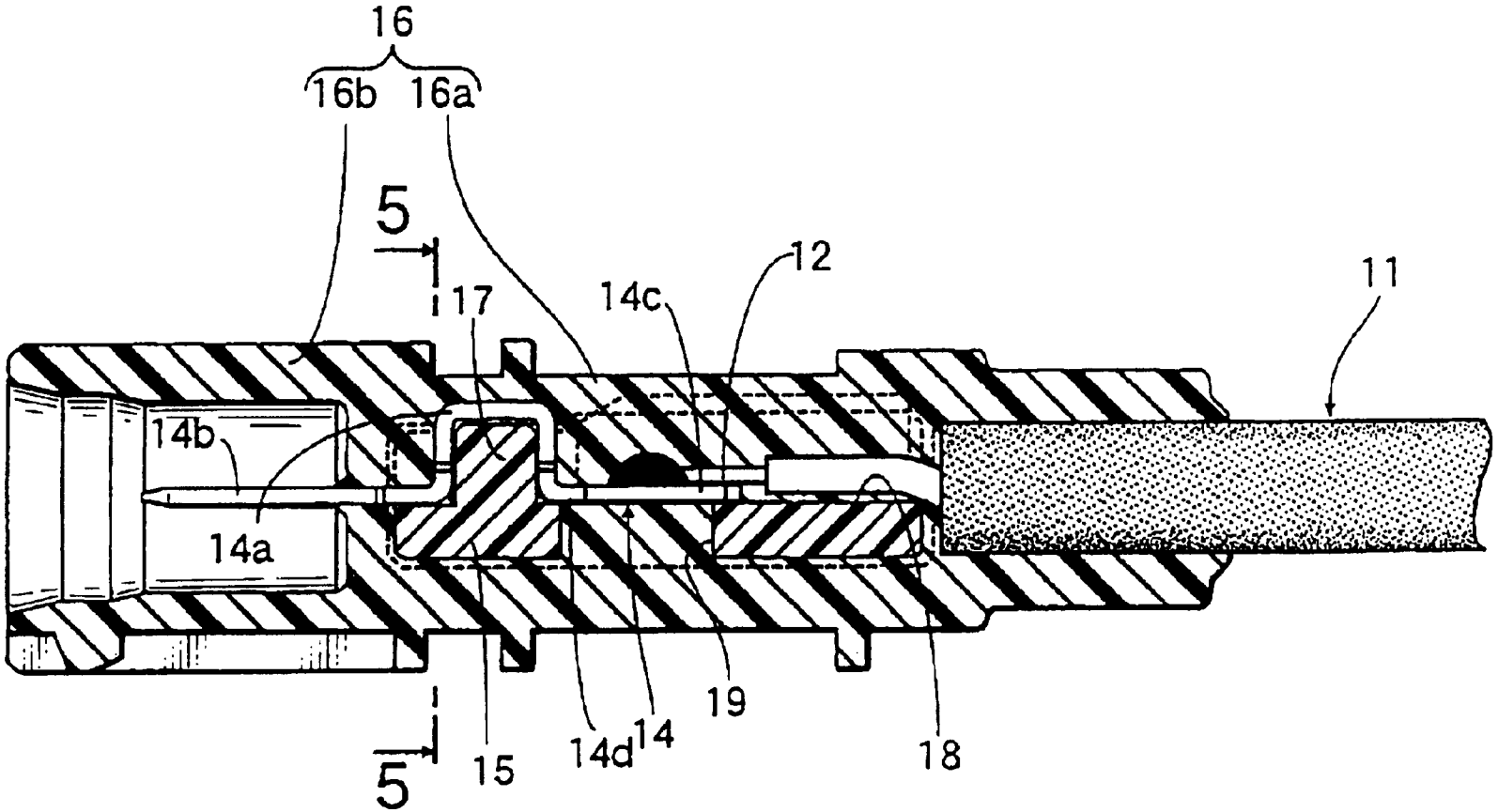
FIG. 4 is a cross sectional view taken along line 4—4 in FIG. 3.
Figure 5:
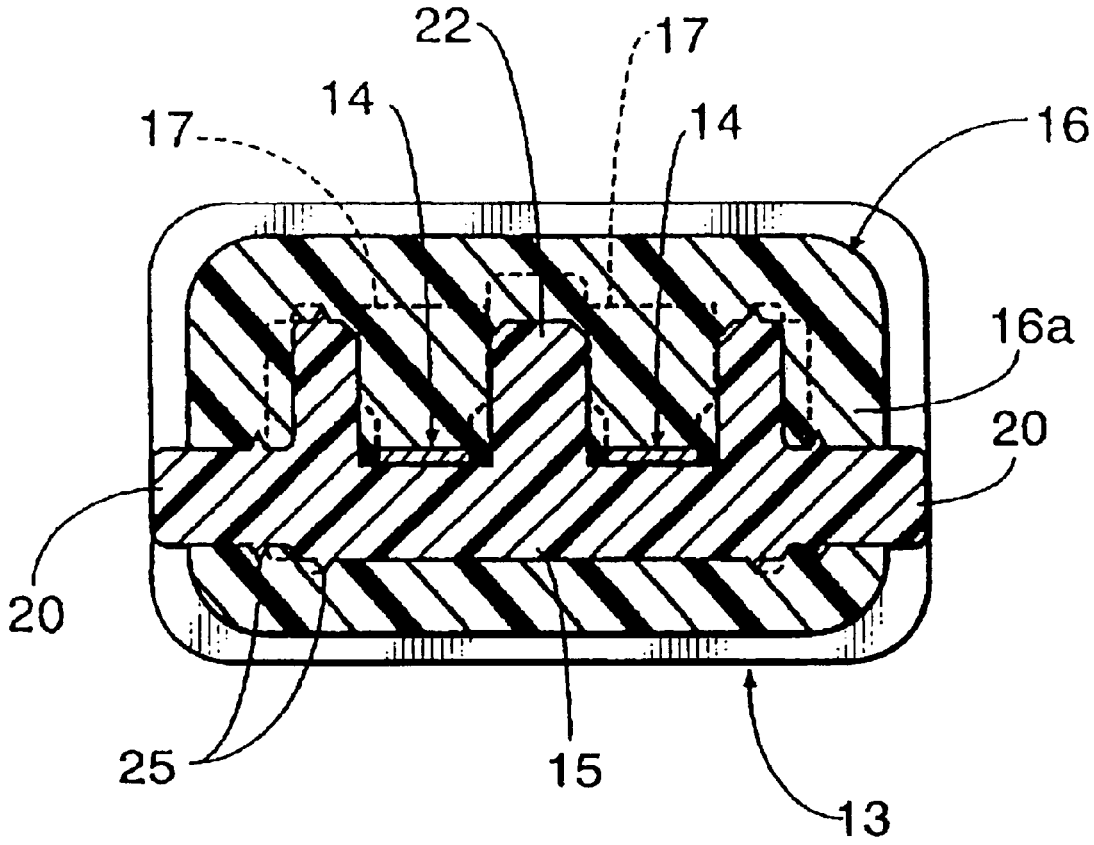
FIG. 5 is a cross sectional view taken along line 5—5 in FIG. 4.
Figure 6:
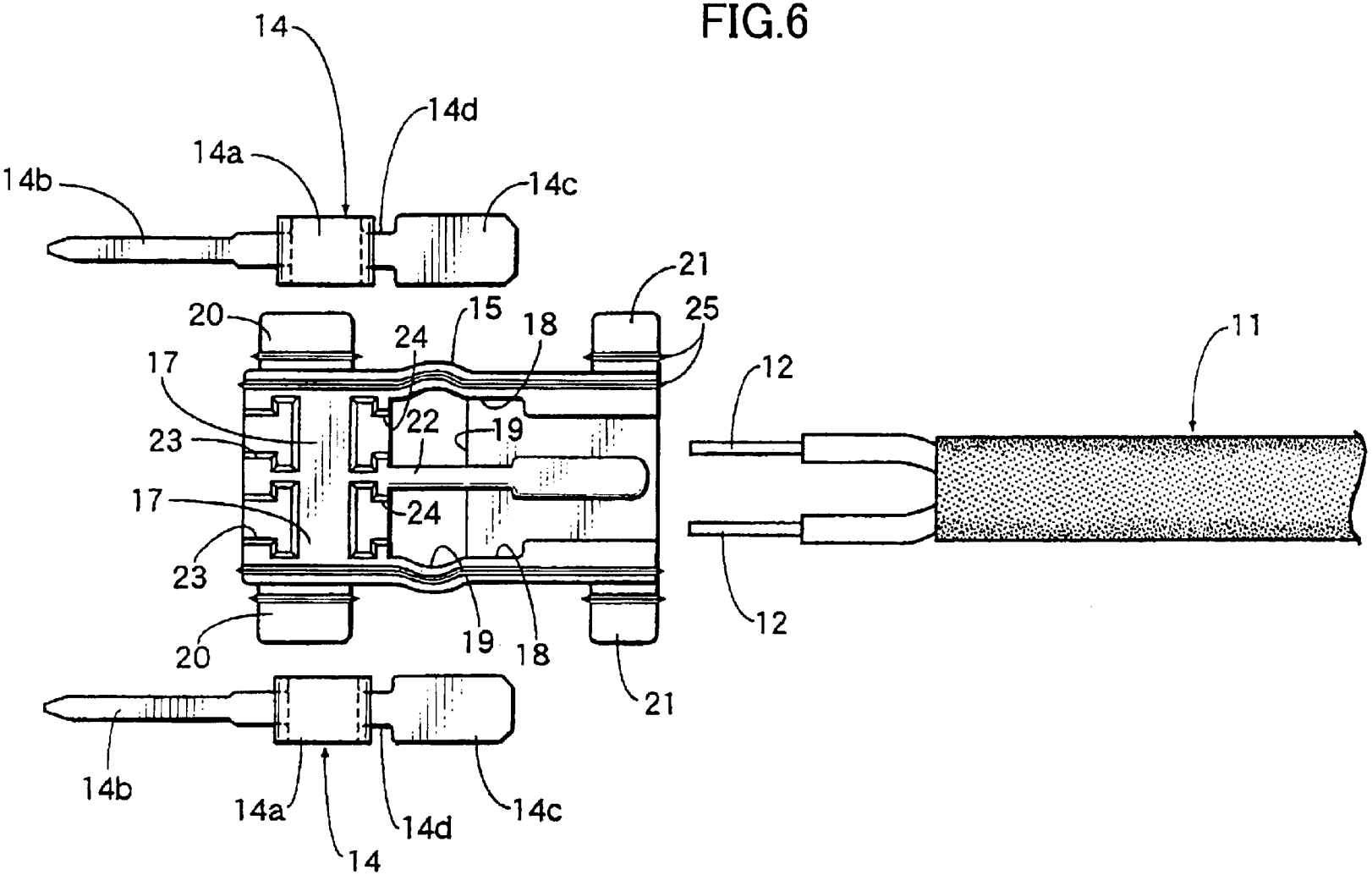
FIG. 6 is a plan view showing a holder, terminals and a cord in an exploded state.

FIG. 1 to FIG. 6 show a preferred embodiment of the invention, in which FIG. 1 is a side elevational view, FIG. 2 is a perspective view showing the steps of manufacturing the electrical connector successively, FIG. 3 is a cross sectional view taken along line 3—3 in FIG. 1, FIG. 4 is a cross sectional view taken along line 4—4 in FIG. 3, FIG. 5 is a cross sectional view taken along line 5—5 in FIG. 4, and FIG. 6 is a plan view showing a holder, terminals and a cord in an exploded state.

At first, in FIG. 1 and FIG. 2, a cord 11 is used for transmitting signals, for example, from a sensor attached to a vehicle, and an electrical connector 13 is attached to the end of the cord 11.

The electrical connector 13 is formed by insert molding, a portion of the cord 11 having plural, for example, a pair of electric wires 12 and 12, a portion of plural, for example, a pair of metallic terminals 14 and 14 having electric wire connection parts 14*c* and 14*c* connected respectively and electrically to the respective ends of the electric wires 12 and 12 and a holder 15 made of a synthetic resin in a connector housing 16 made of a synthetic resin.

Referring to FIG. 2, both of the terminals 14 and 14 are at first assembled to the holder 15, ends of the electric wires 12 and 12 of the cord 11 are further joined to both of the terminals 14 and 14 in a state joined to the holder 15, and the ends for the respective electric wires 12 and 12 and the terminals 14 and 14 are electrically connected by resistance welding. In this state, the holder 15, a portion of the pair of terminals 14 and 14 assembled to the holder 15, and the portion of the cord 11 with each of the electric wires 12 and 12 connected electrically to the terminals 14 and 14 are covered with the connector housing 16 to constitute the electrical connector 13.

Referring also to FIG. 3 to FIG. 6 together, the holder 15 comprises a pair of holding portions 17 and 17 for holding the pair of the terminals 14 and 14 in parallel, plural, for example, a pair of containment grooves 18 and 18 in contiguous with the holding portions 17 and 17 respectively while accommodating the electric wire connection parts 14*c* and 14*c* of the terminals 14 and 14 held by the holding portions 17 and 17, and a portion of the electric wires 12 and 12 to be connected with the electric wire connection parts 14*c* and 14*c*, welding windows 19 and 19 formed by recessing a portion of the bottom of the respective containment grooves 18 and 18 for enabling electric connection between the electric wire connection parts 14*c* and the ends of the electric wires 12 and 12, and plural supports 20 and 21 for abutting against and supported on the die for molding the connector housing 16.

By the way, each terminal 14 is a one piece member having a central bent part 14*a* bent into a substantially U-shaped configuration, a terminal connection part 14*b* in contiguous at a right angle with one end of the central bent part 14*a* and to be electrically connected with an external female terminal (not illustrated) and an electric wire connection part 14*c* in contiguous at a right angle with the other end of the central bent part 14*a*. The terminal connection part 14*b* and the electric wire connection part 14*c* are disposed in contiguous with both ends of the central bent part 14*a* so as to be arranged on one identical plane. The electric wire connection part 14*c* has a width identical with that of the central bent part 14*a*. A head part 14*d* with a width narrower than that of the central bent part 14*a* is formed to a portion of the electric connection part 14*c* near the central bent part 14*a*.

A pair of holding portions 17 and 17 and two rows of containment grooves 18 and 18 are formed on one surface of the holder 15, with a partition wall 22 being put between the portions 17 and 17 and between the grooves 18 and 18. Each holding portion 17 has a substantially inverted U-shaped configuration complementary to the shape of the central bent portion 14*a* and is formed to the holder so as to hold each terminal 14 by fitting the central bent part of each terminal 14 from the side on one surface of the holder 15. Each of the holding portions 17 and 17 is opened at one end to the outside on one end of the holder 15 through each of narrow width openings 23 and 23 while each holding portion 17 is in contiguous at the other end with each containment groove 18 by way of a narrow width communication port 24 such that the base part, that is, the head part 14*d* of the electric wire connection part 14*c* can be arranged.

Then, in a state where the central bent parts 14*a* and 14*a* for both of the terminals 14 and 14 are fitted and held to the holding portions 17 and 17, the terminal connection parts 14*b* and 14*b* are protruded from the holder 15, and the electric wire connection parts 14*c* and 14*c* are contained in the containment grooves 18 and 18 which are in contiguous with the holding portions 17 and 17 respectively.

The ends of the pair of the electric wires 12 and 12 protruded from the end of the cord 11 are contained from the other end of the holder 15 into the containment grooves 18 and 18 respectively so as to be stacked on the electric connection parts 14*c* and 14*c* of the terminals 14 and 14. Further, the welding windows 19 and 19 are formed to the holder 15 by recessing a portion of the bottom of both of the containment grooves 18 and 18 such that the electric wire connection parts 14*c* and 14*c* and the ends of the electric wires 12 and 12 can be welded by resistance welding being sandwiched at both sides. Further, supports 20 and 21 are formed integrally to the holder 15 so as to protrude from the both ends of the holder 15 to both lateral sides. The top ends of the supports 20 and 21 are situated facing the outer surface of the connector housing 16 after molding the connector housing 16 covering the holder 15.

Plural ridges 25 and 25 each having a trigonal transversal cross sectional shape are formed integrally to the outer surface of the holder 15 at plural positions for enhancing close adhesion with the connector housing 16 by the melting of the top ends of them upon insert molding of the connector housing 16 thereby improving the sealability.

The connector housing 16 comprises a housing main part 16*a* for covering the holder 15, a portion of the pair of terminals 14 and 14 assembled to the holder 15, and a portion of the cord 11 with the respective electric wires 12 and 12 thereof being electrically connected to the terminals 14 and 14, and a connection cylindrical portion 16*b* integrally contiguous with the housing main part 16*a* . The terminal connection parts 14*b* and 14*b* of both of the terminals 14 and 14 are arranged in parallel within the connection cylindrical portion 16*b* while being protruded from the holder 15.

The advantages of this embodiment based on the constitutions thereof are to be described. In the electrical connector 13, the holder 15, a portion of the pair of terminals 14 and 14 assembled to the holder 15, and a portion of the cord 11 with the respective electric wires 12 and 12 thereof being connected electrically to the terminals 14 and 14 are covered with the connector housing 16 made of a synthetic resin. The holder 15 comprises the holding portions 17 and 17 for holding the pair of the terminals 14 and 14 in parallel respectively, and two rows of containment grooves 18 and 18 in contiguous with the holding portions 17 and 17 respectively so as to accommodate the electric wire connection parts 14*c* and 14*c* of the terminals 14 and 14 held by the holding portions 17 and 17, and a portion of the electric wires 12 and 12 to be connected with the electric wire connection portions 14*c* and 14*c*, welding windows 19 and 19 formed by recessing a portion of the bottom of the containment grooves 18 and 18, such that each electrical connection portion 14*c* and each electric wire 12 can be connected electrically by resistance welding and plural supports 20 and 21 abutting against and supported on a die for molding the connector housing 16.

Accordingly, the electric wires 12 and 12, and the electric wire connection parts 14*c* and 14*c* of the terminals 14 and 14 contained in the containment grooves 18 and 18 can be connected easily by resistance welding utilizing the welding windows 19 and 19 in a state of holding the terminals 14 and 14 to the pair of the holding portions 17 and 17 provided to the holder 15.

In addition, the terminals 14 and 14, and the electric wires 12 and 12 connected with each other can be held stably to the holder 15, and rattling of the holder 15 during die molding of the connector housing 16 can be prevented by abutting and supporting the supports 20 and 21 provided to the holder 15 on the die, which can facilitate the insert molding of the connector housing 16.

While a preferred embodiment of the present invention has been described, the invention is not limited to the example but various design changes are possible without departing from the gist of the invention described in the scope of the claims.

As has been described above, according to the present invention, the electric wires and the electric wire connection portions for the respective terminals contained in respective containment grooves can be connected with ease by resistance welding utilizing the welding windows in a state of holding the terminals respectively to the plural holding portions provided to the holder. In addition, each of the terminals and the electric wires in a state connected to each other can be maintained stably to the holder and insert molding of the connector housing is facilitated by abutting and supporting the supports provided to the holder on the die, thereby suppressing the rattling of the holder during molding of the connector housing.

What is claimed is:

1. An electrical connector formed by insert molding a portion of a code (11) having plural electric wires (12), and a portion of a metallic terminal (14) having electric wire connection parts **(14*c*) connected to the ends of the respective electric wires (12) individually and electrically in a connector housing (16) made of a synthetic resin, wherein a holder (15) covered at least partially with the connector housing (16) comprises holding portions (17) for holding the plural terminals (14) arranged in parallel respectively, plural containment grooves (18) contiguous with the respective holding portions (17) so as to accommodate the electric wire connection parts (14*c*) of the respective terminals (14) held in the holding portions (17) and a portion of the electric wires (12) to be connected with the electric wire connection parts (14*c*), a welding window (19) formed by recessing a portion of the bottom for each of the containment groove (18) so that the electric wire connection part (14*c*) and the terminal of each of the electric wires (12) can be connected electrical by resistance welding, and plural supports (20,21) abutting against and supported on a die for molding the connector housing (16), and wherein the holder (15), a portion of the plural terminals (14) joined with the holder (15) and a portion of the code (11) with each of the electric wires (12) thereof being connected electrically to each of the terminals (14) are covered with the connector housing (16) with the top end of each of the supports (20,21) being exposed to the outer surface of the connector housing (16)**.

2. An electrical connector according to claim 1, wherein each terminal (14) is formed of a one piece member having a central bent part (14), a terminal connection part **(14*b*) contiguous with one end of the central bent part (14*a*) and electrically connected with an external female terminal and an electric wire connection part (14*c*) contiguous with the other end of the central bent part, and the holding portion (17) has a configuration complementary to the shape of the central bent portion (14*a*) and is formed to the holder (15) so as to hold each terminal (14) by fitting the central bent part (14*a*) of each terminal to each holding portion (17)**.

* * * * *